United States Patent [19]

Beaver

[11] Patent Number: 4,660,233

[45] Date of Patent: Apr. 28, 1987

[54] PORTABLE SHAMPOO, MANICURE, AND WASHING APPARATUS

[76] Inventor: Lueretta Beaver, Rte. 1, Box 812, Splendora, Tex. 77372

[21] Appl. No.: 816,828

[22] Filed: Jan. 7, 1986

[51] Int. Cl.[4] ..... A45D 19/04

[52] U.S. Cl. ..... 4/516; 4/517; 4/518; 4/519; 4/523

[58] Field of Search ..... 4/515, 516, 517, 518, 4/519, 522, 520; D20/28; 4/523, 619, 596, 559, 585

[56] References Cited

U.S. PATENT DOCUMENTS

| | | | |
|---|---|---|---|
| D. 195,396 | 6/1963 | Barkus | D28/20 |
| 2,682,058 | 6/1954 | Wolfe | 4/516 |
| 2,760,207 | 8/1956 | Glintz | 4/516 |
| 2,850,742 | 9/1958 | Glintz | 4/516 |
| 3,013,280 | 12/1961 | Coffman et al. | 4/516 |
| 3,192,537 | 7/1965 | Coffman et al. | 4/516 |
| 3,694,826 | 10/1972 | Pugh | 4/516 |
| 4,081,867 | 4/1978 | Simeola | 4/516 |

*Primary Examiner*—Henry K. Artis

*Attorney, Agent, or Firm*—Solon B. Kemon

[57] ABSTRACT

A completely self-contained portable apparatus useful primarily in hospitals and nursing homes for washing, shampooing, pedicuring and manicuring bed-ridden persons is disclosed. A wheeled cabinet, houses clean and waste water tanks as well as heating and pressurizing means for the clean water. Head and foot basins each with drain connections to the waste water tank are pivotally mounted on lining arms which permit them to fold into a non-use position overlying each other and the cabinet and an extended position overlying a bed when in use. The support mounting the basins on the cabinet also provides for vertical adjustment to accommodate different bed heights. Spray nozzles connected to the pressurized, heated and clean water tank are extendible by means of hoses to reach either the head or foot basins when in extended operative position.

1 Claim, 5 Drawing Figures

PORTABLE SHAMPOO, MANICURE, AND WASHING APPARATUS

BACKGROUND OF THE INVENTION

While there are known devices in the prior art for administering shampoos to bed-ridden persons, (see for example, U.S. Pat. No. 3,192,537), there exists a need for devices of this general type which are completely self-contained and useful not only for beauty treatments, but also for medical uses. Accident victims are often brought in the hospitals with head and/or feet having been temporarily bandaged at the accident scene by paramedics and it is necessary to remove such bandaging for further diagnosis and treatment with minimum movement of the victim while horizontally positioned on a hospital bed or gurney. This requires means for washing the body extremities with clean warm water to remove blood soaked bandages and dirt.

BRIEF DESCRIPTION OF THE INVENTION

The present invention includes a wheeled cabinet having clean and waste water tanks as well as means for electrically heating the clean water and supplying it under pressure to spray nozzles connected to extensible hoses also housed within the cabinet. Head and foot basins with flexible drain hose connections to the waste water tank are supported on the cabinet by linkage which permits them to be positioned outwardly of the cabinet over the head and foot portions of the bed and also vertically adjustable to accommodate different bed heights. The basins are positionable when not in use to overlie each other and the cabinet to form a compact easily movable unit.

DETAILED DESCRIPTION

Figure 1:
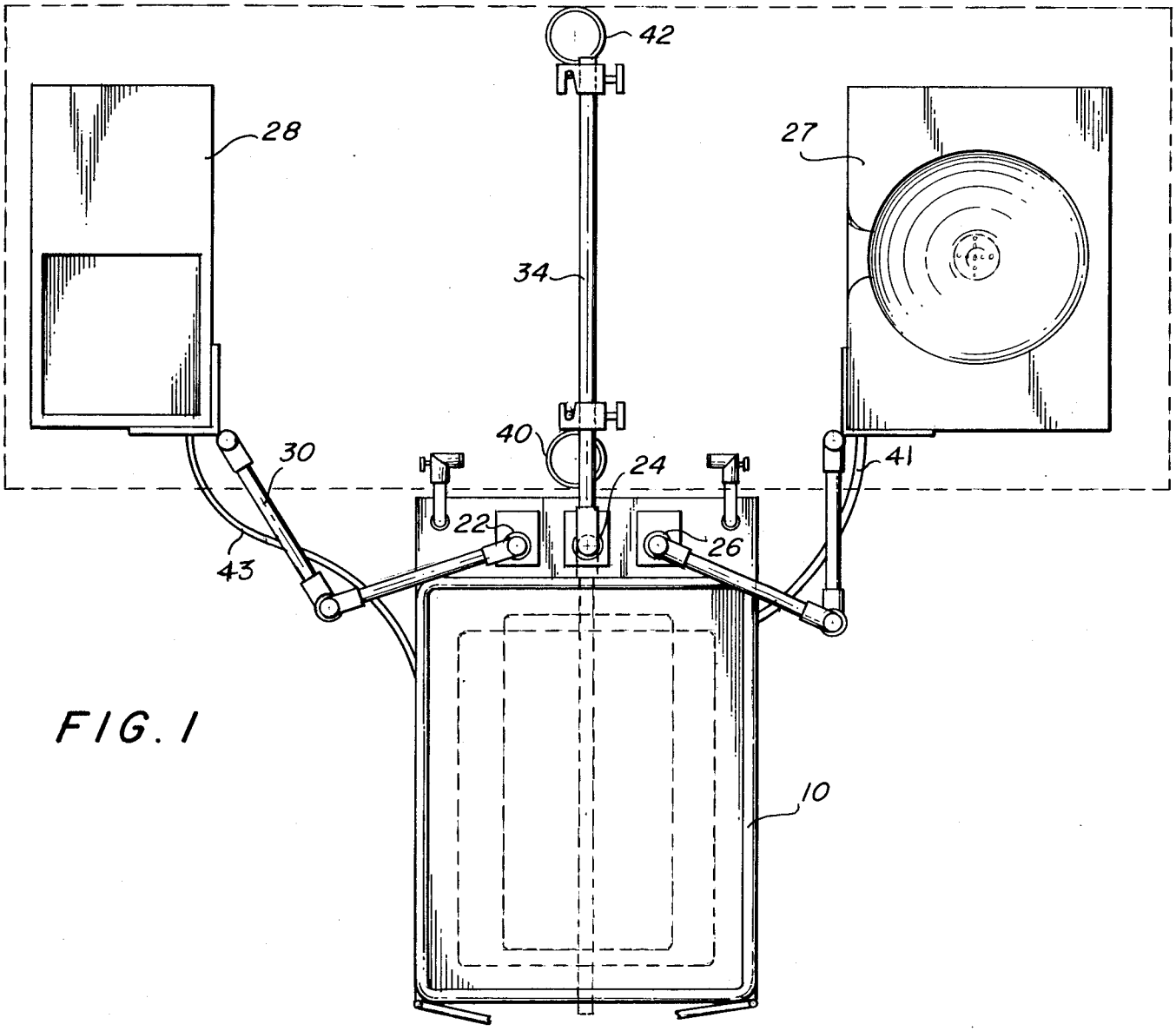
FIG. 1 is a top plan view of the apparatus of this invention in operative position with portions adjacent and overlying a bed.
Figure 2:
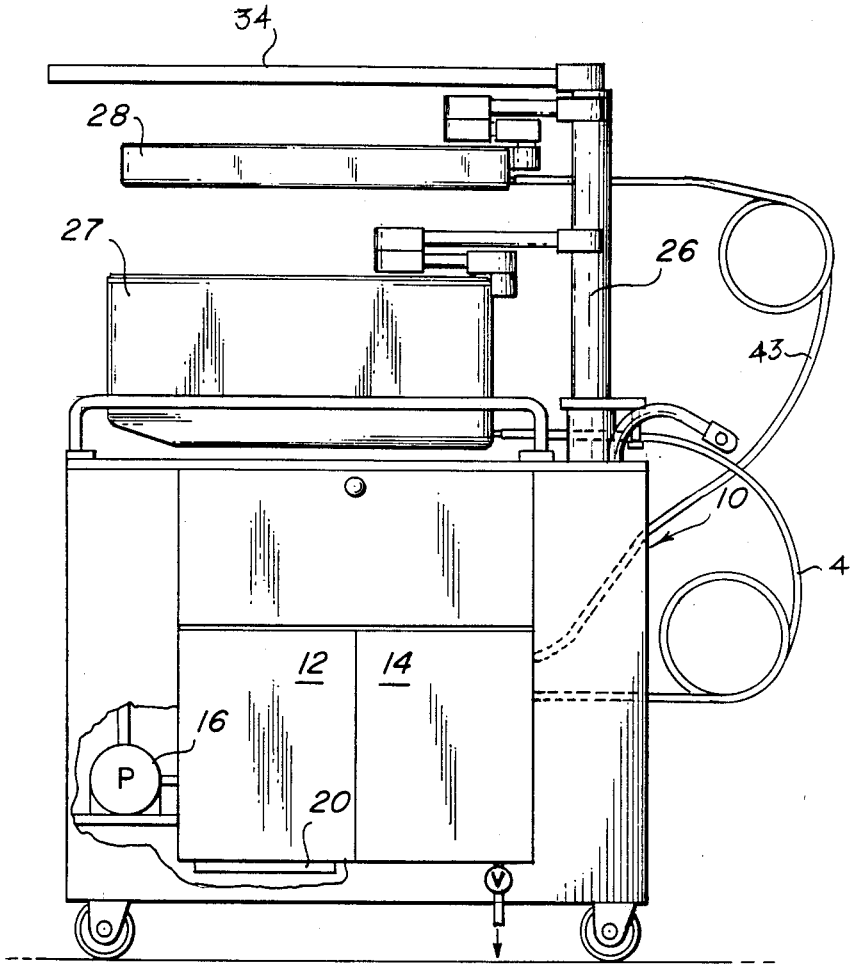
FIG. 2 is a side elevation of the device shown in FIG. 1 with all parts folded to inoperative position.

Referring first to FIGS. 1 and 2, a wheeled cabinet 10 houses adjacent clean and waste water tanks 12 and 14 as well as pump means 16 for supplying water under pressure to spray nozzles 17 and 18. An electrically operated heater means 20 is associated with the clean water tank and is preferably thermostatically controlled.

Figure 3:
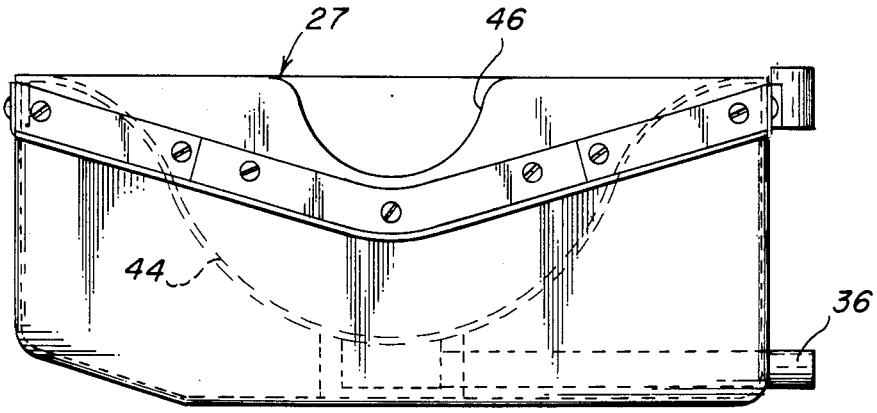
FIG. 3 is a side view of the head basin.
Figure 4:
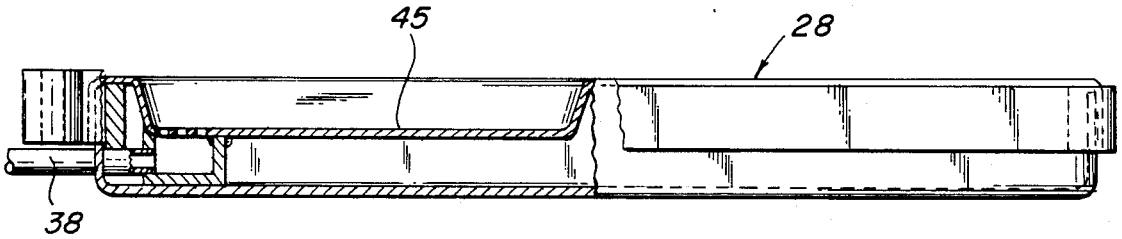
FIG. 4 is a side view of the foot basin.

Mounted along one side of the cabinet 10 are three telescopic vertically adjustable columns 22, 24 and 26. A foot basin 28 as shown in FIGS. 1 and 4 is pivotally mounted on a pair of pivotally connected arms 30 and 32 which in turn are pivotally mounted on the vertically adjustable column 22. A head basin shown in FIGS. 1 and 3 is similarly mounted on column 26. On the center column 24, there is mounted a rigid bar 34 which is also pivotally mounted on column 24 so that all three members which are shown extended across the bed in FIG. 1 may be folded to overlie each other and the cabinet as shown in FIG. 2. Referring to FIGS. 2, 3 and 4, the drain fittings 36 and 38 for the head and foot basins respectively are connected by flexible hoses 41 and 43 to the waste water tank 14. Adjustably mounted on the bar 34 are a pair of cup members 40 and 42 which can be used for manicuring purposes if desired.

Referring to FIG. 3, the head basin 27 will be seen to include a contoured liner 44 having a neck receiving opening 46. The base of the liner communicates with a drain member 36 which is connected by means of a flexible hose to the waste water tank 14.

The foot basin 28 shown in FIG. 4 also includes a liner 45, the underside of which communicates with the drain fitting 38 which in turn is connected to the waste water tank through a flexible hose.

Figure 5:
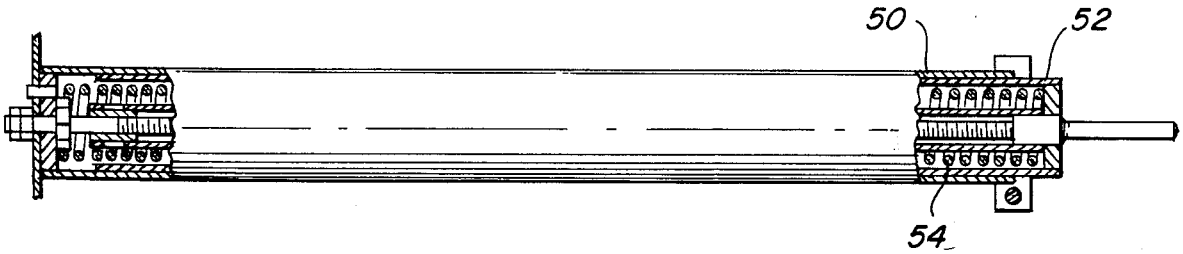
FIG. 5 is a side elevation partially in section of one of the vertically adjustable columns for supporting the basins.

As shown in the partially sectional view in FIG. 5, each of the three vertical columns which support the implements to be positioned over the patient's bed include telescopic members 50 and 52. The inner member 52 is urged vertically upwards by means of a spring 54. The desired elevation of either of the basin members or bar are determined by pressing downwardly on the uppermost end of the telescopic support column and then securing the column to the desired position by means of a clamp attached to the outer member 50 which is stationary and which clamps surround the inner member 52 to hold it in any desired position.

While a preferred embodiment has been herein shown and described, applicant claims the benefit of a full range of equivalents within the scope of the appended claims.

I claim:

1. A portable, self contained, washing, shampooing, pedicuring and manicuring apparatus for use with bed-ridden persons comprising:

a wheeled cabinet having fresh and waste water tanks therein;

means in said cabinet for pressurizing and heating the water in said fresh water tank;

a foot basin having a drain fitting connected by a flexible hose line to said waste water tank;

a head basin having a drain fitting connected by a flexible hose line to said waste water tank;

extensible spray nozzle means carried by said cabinet and connected to said pressurizing means;

means separately supporting said basins on said cabinet for vertical and horizontal adjustment to operative position over an adjacently positioned bed and permitting pivoting said basins to overlie each other and said cabinet in inoperative position for storage and for moving purposes;

a pair of open top receptacles for manicuring, adjustably supported in spaced relation on an elongated rigid bar member; and means pivotally supporting said bar on a vertically adjustable column carried by said cabinet between said basin support means so that said bar may be placed in operative position over an adjacent bed and pivoted to inoperative position aligned with said cabinet and said basins.

* * * * *